United States Patent [19]

Sakurai

[11] Patent Number: 4,571,938

[45] Date of Patent: Feb. 25, 1986

[54] EXHAUST GAS CLEANING DEVICE FOR DIESEL ENGINES

[75] Inventor: Shigeru Sakurai, Hiroshima, Japan

[73] Assignee: Mazda Motor Corporation, Hiroshima, Japan

[21] Appl. No.: 526,884

[22] Filed: Aug. 26, 1983

[30] Foreign Application Priority Data

Aug. 27, 1982 [JP] Japan ..... 57-149729

[51] Int. Cl.[4] ..... F01N 3/02

[52] U.S. Cl. ..... 60/303; 55/466; 55/DIG. 30; 60/311

[58] Field of Search ..... 60/297, 286, 311, 303; 55/466, DIG. 10, DIG. 30, 283

[56] References Cited

U.S. PATENT DOCUMENTS

| | | | |
|---|---|---|---|
| 3,073,684 | 1/1963 | Williams | 60/303 |
| 3,484,189 | 12/1969 | Hardison | 60/303 |
| 3,804,597 | 4/1974 | Inoue | 60/303 |
| 4,345,431 | 8/1982 | Suzuki | 60/303 |
| 4,424,671 | 1/1984 | Tokura | 60/274 |

FOREIGN PATENT DOCUMENTS 49-71315 7/1974 Japan .

*Primary Examiner*—Douglas Hart

*Attorney, Agent, or Firm*—Fleit, Jacobson, Cohn & Price

[57] ABSTRACT

An exhaust gas cleaning device for diesel engines including a filter provided in an exhaust gas passage of the diesel engine for trapping particulate materials in exhaust gas passing through the exhaust gas passage, and a burner upstream of the filter for burning the particulate materials deposited on the filter. The filter has a gas inlet surface which is perpendicular to an axial direction along which the exhaust gas is passed and where the particulate materials are apt to be deposited. The burner include a fuel nozzle and a combustion chamber for effecting combustion of fuel from the fuel nozzle. A mixing chamber is provided between the combustion chamber and the filter for drawing the engine exhaust gas to mix it with combustion gas from the combustion chamber. The mixing chamber has an inlet communicating with the combustion chamber and an outlet opposite to the inlet. The gas inlet surface of the filter is exposed to the mixing chamber at the outlet.

7 Claims, 3 Drawing Figures

EXHAUST GAS CLEANING DEVICE FOR DIESEL ENGINES

FIELD OF THE INVENTION

The present invention relates to an exhaust gas cleaning device for diesel engines, and more particularly to an exhaust gas cleaning device which includes filtering means for trapping particulate materials such as carbon particles in the exhaust gas, and burner means for burning and removing the particulate materials deposited on the filtering elements.

BACKGROUND OF THE INVENTION

It has been known, as disclosed for example in U.S. Pat. No. 4,345,431 and Japanese Patent Public Disclosure No. 49-71315 to provide an exhaust gas cleaning device having filter means in the exhaust gas passage of a diesel engine to trap particulate materials in the exhaust gas, thereby to prevent particulates from being discharged with the exhaust gas. Such filter means is provided with burner means upstream the filter means to have carbon particles on the filter burnt, thereby to prevent clogging of the filter. The filter means includes a filter element which is of a cylindrical configuration and arranged so that the exhaust gas is passed through the filter element radially inwardly or outwardly. In this type of arrangement, the burner is located adjacent to one axial end of the filter element so that the flame from the burner is applied in a parallel direction to the cylindrical inner or outer surface of the element where the exhaust gas enters the filter element. It should, however, be noted that the arrangement is disadvantageous in that the burner flame cannot be applied uniformly on the filter surface where carbon particles are apt to be deposited so that carbon deposits cannot satisfactorily be removed. Moreover, there is a risk that the filter element is locally overheated by the burner flame to the extent that the life of the burner is shortened. It should further be noted that, in the above-mentioned type of exhaust gas cleaning devices, the arrangement is such that the flame from the burner is mixed with the exhaust gas before the combustion is completed so that burner fuel is not completely burnt before it reaches the filter element. As a result, an increased amount of fuel is required for preventing clogging of the filter, causing poor fuel economy of the engine. On the other hand, in order to obtain complete combustion of the burner fuel, it is required to increase the length of the burner, producing a problem of providing increased space for the burner.

SUMMARY OF THE INVENTION

It is therefore an object of the invention to provide an exhaust gas cleaning device for diesel engines having a burner for removing carbon deposits on a filter element, the burner being capable of applying flame uniformly on the surface where carbon particles are apt to be deposited.

Another object of the present invention is to provide an exhaust gas cleaning device having a burner for removing carbon deposits on a filter element, the burner being arranged so that efficient fuel combustion can be ensured without increasing the burner length.

It is a further object to provide an exhaust gas cleaning device which is compact in structure and requires little space for installation.

According to the present invention, the above and other objects can be accomplished by an exhaust gas cleaning device for a diesel engine which comprises filter means provided in exhaust gas passage means of the diesel engine for trapping particulate materials in exhaust gas passing through the exhaust passage means, burner means upstream of the filter means for burning the particulate materials deposited on the filter means, said filter means having gas inlet surface means which is substantially perpendicular to an axial direction along which the exhaust gas is substantially passed and where the particulate materials are apt to be deposited, said burner means including fuel nozzle means and combustion chamber means for effecting combustion of fuel from the fuel nozzle means, mixing chamber means provided between said combustion chamber means and said filter means for drawing the engine exhaust gas to mix it with combustion gas from the combustion chamber means, said mixing chamber means having inlet means communicating with said combustion chamber means and outlet means opposite to said inlet means, said gas inlet surface means of the filter means being exposed to said mixing chamber means at the outlet means thereof. Preferably, the filter means has a plurality of small gas inlet openings distributed uniformly on the gas inlet surface means and communicating with a corresponding number of small gas passages extending axially toward the gas outlet surface means, a plurality of gas outlet openings being distributed uniformly on the gas outlet surface means and communicating with a corresponding number of small gas outlet passages extending axially toward the gas inlet surface means, said gas inlet passages being respectively adjacent to said gas outlet passages and separated therefrom by filtering material. This type of filter means is known in the art as a monolithic type. It is preferred that the fuel nozzle means and the combustion chamber means of the burner means are axially aligned with the mixing chamber means and the filter means so that the burner flame can be applied uniformly to the gas entrance surface of the filter means. The combustion chamber means is preferably of a cylindrical configuration, and the mixing chamber means is of a frustoconical configuration having a smaller diameter end connected with the outlet end of the combustion chamber means and a larger diameter end connected with the filter means, exhaust gas chamber means being provided to surround the combustion chamber means and the mixing chamber means, the mixing chamber means being provided with exhaust gas inlet openings to draw the exhaust gas from the exhaust gas chamber means. More specifically, the exhaust gas chamber means and the mixing chamber means are separated from each other by a frusto-conical wall member which has a number of perforations through which the exhaust gas is introduced from the exhaust gas chamber into the mixing chamber. Accordingly, the exhaust gas is well mixed with the flame. It is suitable that the cross-sectional area of the combustion chamber be smaller than the area of the gas inlet surface of the filter means so that the diameter of the mixing chamber is increased from inlet to outlet to thereby allow the burner flame to expand in the mixing chamber and have it applied uniformly to the gas inlet surface of the filter. With this arrangement, it is possible to burn and remove particulate materials deposited on or attached to the filter means, and particularly in the case where the filter means is of the monolithic type, it prevents the filter means from being cracked due to local overheating at the gas inlet surface.

DESCRIPTION OF PREFERRED EMBODIMENTS

The invention will be more fully understood from the following descriptions taking reference to the accompanying drawings.

Figure 1:
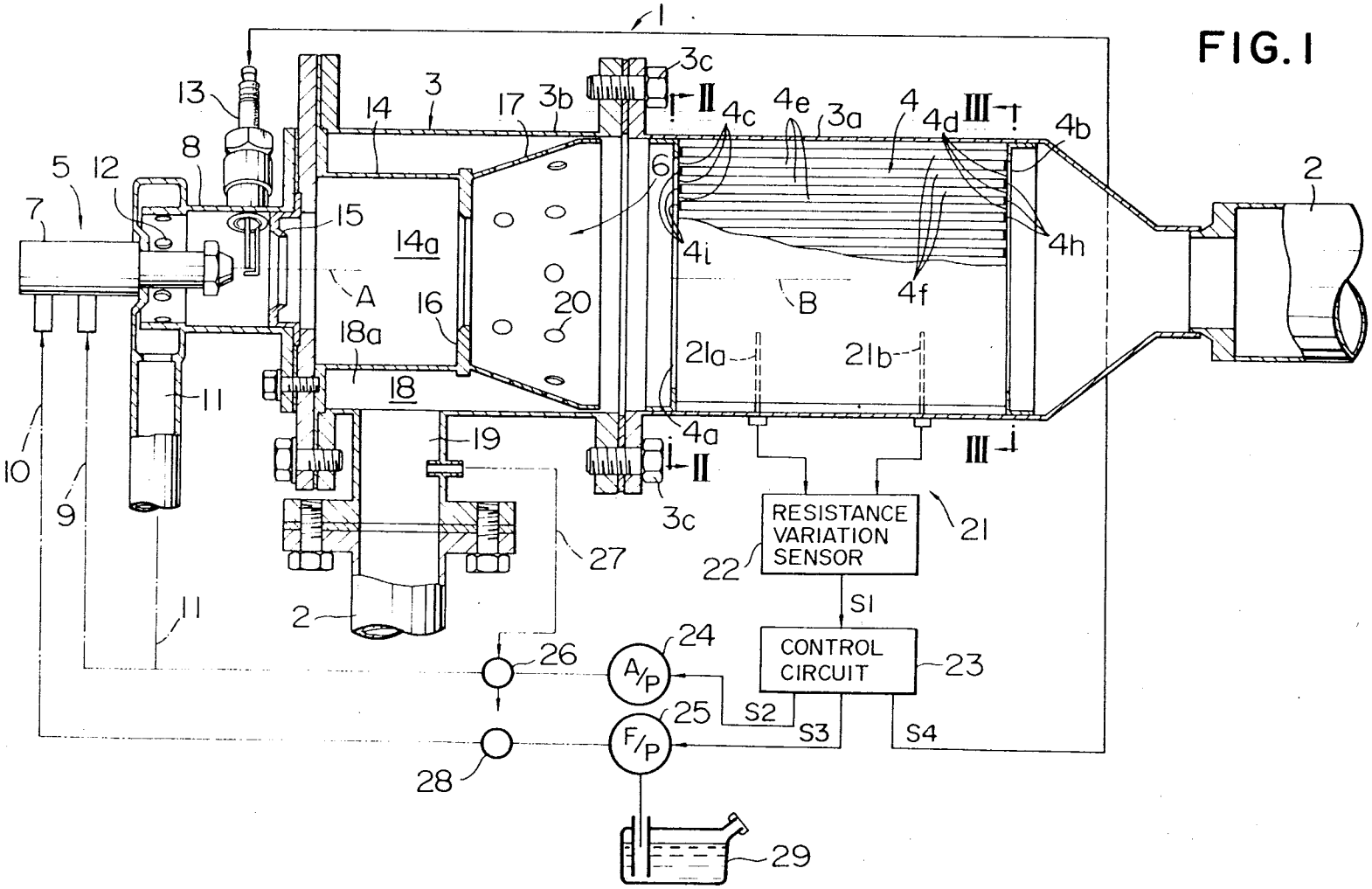
FIG. 1 is a longitudinal sectional view of an exhaust gas cleaning device in accordance with one embodiment of the invention.

Referring first to FIG. 1, the reference numeral 1 denotes an exhaust gas cleaning device of the invention which is provided in an exhaust gas passage 2 of a diesel engine. The cleaning device 1 has a cylindrical casing 3 which comprises a rear casing half 3*a* and a front casing half 3*b* connected with each other by fasteners such as bolts 3*c*. Within the rear casing half 3*a*, there is a filtering member 4 which is adapted to trap particulate materials such as carbon particles in the exhaust gas. Upstream of the filtering member 4, there is a burner assembly 5 for preventing clogging of the filtering member 4. A portion of the burner assembly 5 is arranged within the front casing half 3*b* and faces the filter member 4 in the rear casing half 3*a* through a mixing chamber 6.

Figure 2:
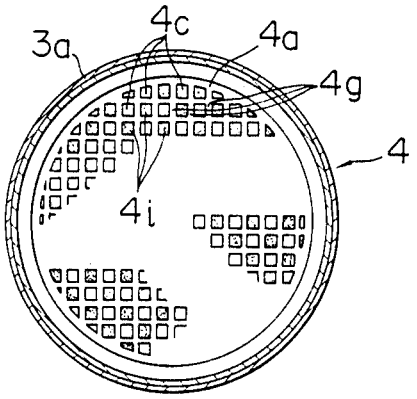
FIG. 2 is a sectional view taken along the line II—II in FIG. 1.
Figure 3:
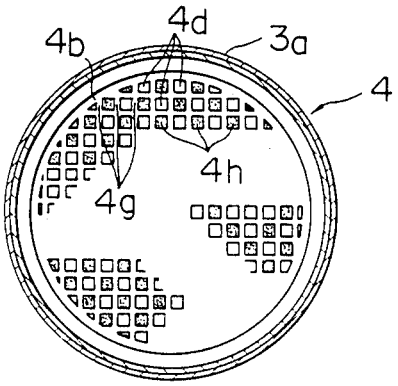
FIG. 3 is a sectional view taken along the line III—III in FIG. 1.

As shown in FIGS. 2 and 3, the filtering member 4 is of a monolithic type made of a heatresistant porous material. More specifically, the filtering member 4 is of a cylindrical configuration and has gas inlet surface 4*a* perpendicular to the longitudinal axis of the filtering member 4, and a gas outlet surface 4*b* which is substantially parallel with the inlet surface 4*a*. A plurality of exhaust gas inlet openings 4*c* are distributed uniformly in the inlet surface 4*a*, and a plurality of exhaust gas outlet openings 4*d* are similarly distributed uniformly in the outlet end face 4*b*. Exhaust gas inlet passages 4*e* extend respectively from the inlet openings 4*c* toward the outlet end surface 4*b*, and exhaust gas outlet passages 4*f* extend respectively from the outlet openings 4*d* toward the inlet end face 4*d*. The inlet passages 4*e* are respectively adjacent with the outlet passages 4*f* and separated therefrom by walls 4*g* of filtering material. Thus, the gas enters the filtering member 4 at the inlet surface 4*a* into the inlet passage 4*e* and passes through the walls of the filtrating material to the outlet passages 4*f* to be exhausted at the outlet surface. In this course, the exhaust gas is filtered by having the particulate materials, such as carbon particles, trapped by means of the filtering walls 4*g* when the exhaust gas passes through the walls 4*g* from the inlet passages 4*e* to the outlet passages 4*f*.

The burner assembly 5 has a fuel injection nozzle 7 which is supported on a mounting tube 8. The mounting tube 8 is in turn mounted on the front casing half 3*b* at an end opposite to the end which is connected with the rear casing half 3*a*. The fuel injection nozzle 7 is arranged to face the central portion of the exhaust gas inlet end face 4*a* of the filtering member 4 so that the center line A of the fuel flow injected by the injection nozzle 7 is registered with the center line B of the exhaust gas flow in the filtering member 4.

The fuel injection nozzle 7 is connected with primary air passage 9 and a fuel passage 10. The fuel which is supplied to the injection nozzle 7 through the fuel passage 10 is premixed with the air supplied through the primary air passage 9 in the nozzle 7 and injected therefrom into a space defined by the mounting tube 8. A secondary air passage 11 is connected with the mounting tube 8 through openings 12 which are formed in one end portion of the tube 8. An ignition plug 13 is mounted to project into the mounting tube 8 downstream of the fuel injection nozzle 7.

In the front casing half 3*b* there is a cylindrical combustion chamber wall 14 which is connected at its front end with the rear end of the mounting tube 8. The combustion chamber wall 14 has a diameter smaller than the diameter of the front casing half 3*b*, and is arranged coaxially therewith. First and second combustion rings 15 and 16 are disposed at the front and rear ends of the combustion chamber wall 14, respectively, to define together a combustion chamber 14*a* which communicates with the inside of the mounting tube 8 to receive combustion flame therefrom and have the combustion completed. A frusto-conical wall member 17 is connected at its front end with the second ring 16, and extends to the rear end of the front casing half 3*b*. Within the wall member 17, there is defined a mixing chamber 6 which is located between the combustion chamber 14*a* and the filtering member 4. The wall member 17 flares outwardly and increases in diameter toward the filtering member 4 so that the mixing chamber 6 is expanded and diverges toward the filtering member 4.

An exhaust gas chamber 18 is formed between the front casing half 3*b* and the combustion chamber wall 14 and the wall member 17, and is connected at its front portion 18*a* around the combustion chamber 14*a* with the exhaust pipe 2 through an exhaust gas introduction pipe 19. The wall member 17 has a plurality of uniformly distributed perforations 20 so that the exhaust gas passage 18 communicates with the mixing chamber 6 through these perforations 20. Thus, the exhaust gas first enters the front portion 18*a* of the exhaust gas chamber 18 from the exhaust pipe 2 to preheat the gas in the combustion chamber 14*a* so as to help the flame burn completely. Then, the exhaust gas is introduced through the perforations 20 of the wall member 17 into the mixing chamber 6 to be mixed with the combustion gas from the chamber 14*a*. Since, as mentioned above, the wall member 17 is in the form of a frustum of a cone, which increases in diameter toward the filtering member 4, the flame which enters the mixing chamber 6 is diffused or expanded so that it is possible to have the combustion gas from the combustion chamber 14*a* to be well mixed with the exhaust gas introduced through the perforations 20. It will therefore be understood that the hot combustion gas is distributed uniformly in the mixing chamber 6. As a result, the hot combustion gas in the mixing chamber 6 is applied uniformly throughout the exhaust gas inlet surface 4*c* of the filtering member 4.

The exhaust gas cleaning device 1 has a clog sensor 21 which is provided in the filtering member 4 to detect that particulate materials are deposited on the filtering member beyond a predetermined amount. The clog sensor 21 comprises a pair of electrodes 21*a*, 21*b* which are spaced from each other in the longitudinal direction of the filtrating member 4, and a differential resistance detecting circuit 22 which is electrically connected with the electrodes 21*a*, 21*b*. The circuit 22 functions to detect the resistance value between the electrodes 21*a*, 21*b* and to compare the detected resistance value with a predetermined resistance value that denotes a certain extent of clogging of the filtering member 4, to produce a clog signal S1, which represents that the particulate materials are deposited beyond a predetermined amount on the filtering member 4 when the detected resistance value is smaller than the predetermined resistance value.

The differential resistance detecting circuit 22 is connected with a control circuit 23, which has outputs respectively connected with an air pump 24 and a fuel pump 25. The control circuit 23 produces a first drive signal S2 and a second drive signal S3 which are applied to the air pump 24 and the fuel pump 25, respectively, when it receives the clog signal S1 from the clog sensor 21. Thus, the air pump 24 is driven by the first drive signal S2 to supply air through an air regulating valve 26 to the primary and secondary air passages 9 and 11. The air regulating valve 26 is in communication with the pipe 19 through an exhaust gas pressure passage 27, and regulates the pressure of the air to the passages 9 and 11 to a value higher than the exhaust gas pressure by a certain value, for example, 110 mmHg. The fuel pump 25 is driven by the second drive signal S3 to supply fuel through a fuel regulating valve 28 from a fuel reservoir 29 to the fuel injection nozzle 7. The fuel regulating valve 28 regulates the fuel flow rate to the nozzle 7 to, for example, 1.6 liter/h.

The control circuit 23 further has an output which is connected with the ignition plug 13. The circuit 23 produces a third drive signal S4 to the ignition plug 13 when it receives the clog signal S1. The ignition plug 13 is driven by the third drive signal S4 to ignite the fuel injected from the fuel injection nozzle 7.

The invention has thus been shown and described with reference to a specific embodiment. However, it should be noted that the invention is no way limited to the details of the illustrated arrangements but changes and modifications may be made without departing from the scope of the appended claims.

What is claimed is:

1. An exhaust gas cleaning device for diesel engines which comprises filter means provided in exhaust gas passage means of the diesel engine for trapping particulate materials in exhaust gas passing through the exhaust passage means, burner means upstream of the filter means for burning the particulate materials deposited on the filter means, said filter means having gas inlet surface means which is substantially perpendicular to an axial direction along which the exhaust gas is substantially passed and where the particulate materials are apt to be deposited, said burner means including fuel nozzle means and cylindrical combustion chamber means for effecting combustion of fuel from the fuel nozzle means, engine exhaust gas introduction means positioned between said fuel nozzle means and said filter means, mixing chamber means provided between said combustion chamber means and said filter means for drawing the engine exhaust gas to mix it with combustion gas from the combustion chamber means, said burner means, said mixing chamber means and said filter means being arranged in a line, said mixing chamber means having inlet means communicating with said combustion chamber means and outlet means opposite to said inlet means, said mixing chamber means being defined by wall means which flares outwardly from one end adjacent to said combustion chamber means to the other end which is adjacent to the filter means, said wall means having a diametrical dimension at said other end which is substantially equal to that of the gas inlet surface means of said filter means and so that said gas inlet surface means of the filter means is completely exposed to said mixing chamber means at the outlet means thereof, said mixing chamber wall means being formed with a plurality of perforations, exhaust gas chamber means provided around said mixing chamber means and around said combustion chamber means so that all the exhaust gas from said exhaust gas chamber means enters the mixing chamber means through said perforations in the wall means and downstream of said combustion chamber means, said fuel nozzle means being provided in support tube means which is smaller in diameter than the combustion chamber means and provided at an end of the combustion chamber means opposite to the mixing chamber means, ignition means provided in the support tube means in the vicinity of the fuel nozzle means, air inlet means for drawing air into the support tube means around the fuel nozzle means so that the air is mixed with the fuel injected from the fuel nozzle means.

2. An exhaust gas cleaning device in accordance with claim 1 which has a first cylindrical casing housing the filter means, and a second cylindrical casing coaxially with and connected at its one end to the first cylindrical casing, the fuel injection means being disposed on the other end of the second cylindrical casing, the combustion chamber means and the mixing chamber means being disposed in the second cylindrical casing to define the exhaust gas chamber means.

3. An exhaust gas cleaning device in accordance with claim 1 in which said filter means is a monolithic structure made of a heat resistant porous material.

4. An exhaust gas cleaning device for diesel engines comprising filter means provided in exhaust passage means of the engine for trapping particulate materials in exhaust gas passing through the exhaust passage means, the filter means having a gas inlet end face and a gas outlet end face which are axially spaced apart and substantially parallel with each other, a plurality of gas inlet openings distributed substantially uniformly in the gas inlet end face, a plurality of exhaust gas inlet passages extending substantially axially respectively from the gas inlet openings toward the gas outlet end face, a plurality of gas outlet openings distributed uniformly in the exhaust gas outlet end face, a plurality of gas outlet passages extending substantially axially from the gas outlet openings toward the inlet end face, the gas inlet passages and the gas outlet passages being respectively adjacent to each other and separated from each other by walls of filtering material, burner means disposed upstream of the filter means for burning the particulate materials deposited on the filter means, said burner means including fuel injection nozzle means for injecting fuel and a cylindrical wall member defining combustion chamber means for burning fuel injected from said nozzle means, an intermediate frustoconical wall having a small diameter end connected through ring means with said cylindrical wall member and defining mixing chamber means between said combustion chamber means and said filter means, said ring means defining between the combustion chamber means and the mixing chamber means passage means which is smaller in diameter than the combustion chamber means, said frustoconical wall member having a plurality of perforations, said exhaust passage means being in communication with a space around the frustoconical wall member so that the exhaust gas is drawn from the space through the perforations into the mixing chamber means to be mixed with combustion gas from the combustion chamber means, said cylindrical wall member of the burner means, said frustoconical member defining the mixing chamber means and the filter means being substantially axially aligned with one another, said gas inlet end face being located at a large diameter end of said frustoconical wall member so that the gas inlet end face is exposed through the mixing chamber means to the combustion chamber means, said fuel injecting nozzle means being provided in support tube means provided at an end of said combustion chamber means opposite to the frustoconical wall member, said support tube means having a diameter smaller than that of the combustion chamber means and formed with air inlet means for drawing air around said nozzle means, and ignition means provided in said support tube means in the vicinity of the nozzle means.

5. An exhaust gas cleaning device for diesel engines which comprises filter means provided in exhaust gas passage means of the diesel engine for trapping particulate materials in exhaust gas passing through the exhaust passage means, burner means upstream of the filter means for burning the particulate materials deposited on the filter means, said filter means having gas inlet surface means which is substantially perpendicular to an axial direction along which the exhaust gas is substantially passed and where the particulate materials are apt to be deposited, said burner means including fuel nozzle means and combustion chamber means for effecting combustion of fuel from the fuel nozzle means, engine exhaust gas introduction means positioned between said fuel nozzle means and said filter means, mixing chamber means provided between said combustion chamber means and said filter means for drawing the engine exhaust gas to mix it with combustion gas from the combustion chamber means, said burner means, said mixing chamber means and said filter means being arranged in a line, restricted passage defining means provided between said combustion chamber means and said mixing chamber means for defining communication passage means which has a diametrical dimension smaller than that of the combustion chamber means, said mixing chamber means having inlet means communicating with said combustion chamber means and outlet means opposite to said inlet means, said mixing chamber means being defined by wall means which flares outwardly from one end adjacent to said combustion chamber means to the other end which is adjacent to the filter means, said wall means having a diametrical dimension at said other end which is substantially equal to that of the gas inlet surface means of said filter means and so that said gas inlet surface means of the filter means is completely exposed to said mixing chamber means at the outlet means thereof, said mixing chamber wall means being formed with a plurality of perforations, exhaust gas chamber means provided around said mixing chamber means and around said combustion chamber means so that all the exhaust gas from said exhaust gas chamber means enters the mixing chamber means through said perforations in the wall means and downstream of said combustion chamber means, said fuel nozzle means being provided in support tube means which is smaller in diameter than the combustion chamber means and provided at an end of the combustion chamber means opposite to the mixing chamber means, ignition means provided in the support tube means in the vicinity of the fuel nozzle means, air inlet means for drawing air into the support tube means around the fuel nozzle means so that the air is mixed with the fuel injected from the fuel nozzle means.

6. An exhaust gas cleaning device in accordance with claim 5 which has a first cylindrical casing housing the filter means, and a second cylindrical casing coaxially with and connected at its one end to the first cylindrical casing, the fuel injection means being disposed on the other end of the second cylindrical casing, the combustion chamber means and the mixing chamber means being disposed in the second cylindrical casing to define the exhaust gas chamber means.

7. An exhaust gas cleaning device in accordance with claim 5 in which said filter means is a monolithic structure made of a heat resistant porous material.

* * * * *